US009160121B2

(12) United States Patent
Wagner

(10) Patent No.: US 9,160,121 B2
(45) Date of Patent: Oct. 13, 2015

(54) HIGH FREQUENCY COAXIAL CONNECTOR

(75) Inventor: Martin Wagner, Steinach (CH)

(73) Assignee: HUBER+SUHNER AG, Herisau (CH)

( * ) Notice: Subject to any disclaimer, the term of this patent is extended or adjusted under 35 U.S.C. 154(b) by 113 days.

(21) Appl. No.: 14/004,087

(22) PCT Filed: Feb. 7, 2012

(86) PCT No.: PCT/EP2012/052064

§ 371 (c)(1),
(2), (4) Date: Dec. 11, 2013

(87) PCT Pub. No.: WO2012/119826

PCT Pub. Date: Sep. 13, 2012

(65) Prior Publication Data

US 2014/0127940 A1 May 8, 2014

(30) Foreign Application Priority Data

Mar. 8, 2011 (CH) ..... 0394/11

(51) Int. Cl.

| | |
|---|---|
| ***H01R 24/40*** | (2011.01) |
| ***H01R 13/631*** | (2006.01) |
| *H01R 24/50* | (2011.01) |
| *H01R 103/00* | (2006.01) |

(52) U.S. Cl.

CPC ..... *H01R 24/40* (2013.01); *H01R 13/6315* (2013.01); *H01R 24/50* (2013.01); *H01R 2103/00* (2013.01)

(58) Field of Classification Search

CPC ... H01R 13/6315; H01R 13/631; H01R 12/57
See application file for complete search history.

(56) References Cited

U.S. PATENT DOCUMENTS

| | | | | |
|---|---|---|---|---|
| 2,658,183 | A | 11/1953 | Klostermann et al. | |
| 3,713,075 | A * | 1/1973 | Clark | 439/246 |
| 4,846,695 | A * | 7/1989 | Iwabuchi et al. | 439/17 |
| 4,925,403 | A | 5/1990 | Zorzy | |
| 5,879,177 | A * | 3/1999 | Honma | 439/246 |
| 5,980,290 | A * | 11/1999 | Meynier et al. | 439/246 |
| 6,497,579 | B1 * | 12/2002 | Garbini | 439/63 |
| 6,976,862 | B1 * | 12/2005 | Ormazabal Ocerin | 439/246 |
| 8,801,459 | B2 * | 8/2014 | Mrowka | 439/578 |
| 2002/0111057 | A1 | 8/2002 | Bernat et al. | |
| 2003/0060069 | A1 | 3/2003 | Duquerroy et al. | |

(Continued)

FOREIGN PATENT DOCUMENTS

| | | |
|---|---|---|
| CN | 2879475 Y | 3/2007 |
| EP | 0 793 299 A1 | 9/1997 |

(Continued)

*Primary Examiner* — Gary Paumen
(74) *Attorney, Agent, or Firm* — Pauley Erickson & Kottis

(57) ABSTRACT

The invention relates to a high frequency coaxial connector (1) having a first and a second connector part (2, 3). The first connector part (2) comprises an outer conductor (5) and an inner conductor (4) held relative to said outer conductor by means of an insulator (6) and disposed in an opening (11) of the insulator (6). The inner conductor (4) comprises an end piece (8) that is electrically conductively and operatively connected to a connector sleeve (10). The connector sleeve (10) is mechanically operatively connected to the insulator (6) by means of first operative connection means (12, 13), so that the connector sleeve (10) can be tilted relative to the inner conductor (4). An axial displacement can be made possible by means of the active connection to the second connector part (3).

10 Claims, 3 Drawing Sheets

(56) References Cited

U.S. PATENT DOCUMENTS

| | | | |
|---|---|---|---|
| 2004/0038586 | A1 | 2/2004 | Hall et al. |
| 2006/0194465 | A1 | 8/2006 | Czikora |
| 2007/0004276 | A1 | 1/2007 | Stein |
| 2007/0026698 | A1 | 2/2007 | Rosenberger |
| 2007/0251808 | A1 | 11/2007 | Sellner et al. |
| 2008/0057782 | A1 | 3/2008 | Berthet et al. |
| 2009/0149086 | A1 | 6/2009 | Dahms |

FOREIGN PATENT DOCUMENTS

| | | | |
|---|---|---|---|
| EP | 1 028 490 | A1 | 8/2000 |
| EP | 1 207 592 | A2 | 5/2002 |
| GB | 678392 | | 9/1952 |
| JP | 4-32513 | | 5/1992 |
| JP | 2005-93333 | | 4/2005 |
| WO | WO 00/52788 | | 9/2000 |

* cited by examiner

HIGH FREQUENCY COAXIAL CONNECTOR

BACKGROUND OF THE INVENTION

1. Field of the Invention

The present invention relates to a high-frequency coaxial connector, in particular a coaxial connector part for a high-frequency coaxial connector, according to the preamble of the independent patent claim.

2. Discussion of Related Art

Various high-frequency coaxial connectors for the operative connection of printed circuit boards are known from the prior art.

U.S. Pat. No. 4,925,403 was filed in 1988 in the name of Gilbert Engineering Co. US'403 discloses a coaxial connector composed of two connector parts and a transition piece situated in between same. All three connector parts have a comparatively complicated coaxial design. The connector is designed in such a way that a certain lateral offset may be compensated for. Due to the design, no compensation is possible in the axial direction. The transition piece is detachably snapped into the first and the second connector parts.

EP 0793299 was filed in 1997 in the name of Otto Dunkel GmbH. EP'299 discloses a coaxial connector which is used for the reciprocal connection of printed conductors extending in printed circuit boards situated in parallel to one another. The connector likewise includes two connector parts, and a transition piece which may be snapped into the connector parts. It is stated that significant simplification compared to the prior art results due to the insulators of the connector parts having a uniform design.

U.S. Pat. No. 5,980,290 was filed in 1998 in the name of Radiall SA. US'290 likewise relates to a coaxial connector. The connector is composed of two coaxially configured connector parts which are able to compensate for a certain misalignment in the transverse direction. The connector parts have a comparatively complicated, cost-intensive design.

EP 1028490 was filed in 2000 in the name of Radiall SA. EP'490 discloses a one-part coaxial connector which is soldered to printed circuit boards which are to be connected. Although the connector has a simple design, it is not detachable after installation.

WO 00/52788 was filed in 2000 in the name of the present applicant. WO'788 discloses a coaxial connector having two connector parts and a transition piece situated between same. The coaxial connector may compensate for radial as well as axial misalignments. The connector parts and the transition piece are coupled together by snap connections. Spherical surfaces facilitate the necessary play.

EP 1207592 was filed in 2001 in the name of Rosenberger. EP'592 discloses a coaxial connector having two connector parts and a transition piece, likewise having a coaxial design, situated between same. The transition piece allows for a certain compensation in the axial as well as the radial direction. The connector has a comparatively complicated design.

US 2002111057 was filed in 2002 in the name of Harting. In one embodiment, US'057 discloses a multiple connector having two connector parts which, however, do not have a coaxial design. One of the connector parts has multiple sleeves which are used for connecting the conductors. The sleeves are movable to a certain degree in the lateral direction, and are supported by an external housing. The connector is not suitable for transmitting high frequencies.

US 2003060069 was filed in 2002 in the name of Tyco. US'069 discloses a coaxial connector for the operative connection of the printed conductors of two printed circuit boards situated in parallel. The connector is composed of only one connector part having elastically mounted connecting means which connect directly to printed conductors of the one printed circuit board. Little power can be transmitted due to the punctiform connection.

Furthermore, coaxial connectors which are suitable for compensation for certain misalignments are known from the following publications: US 2004038586A, US 2007026698A, US 2007251808A, US 2006194465A, US 2007004276A, CN 2879475Y, US 2008057782A, US 2009149086A, and CN 101459304A. All of the connectors have a comparatively complicated design.

SUMMARY OF THE INVENTION

It is an object of the invention to provide a connector by means of which high-frequency plug-in connections between multiple dispersed points on a printed circuit board (PCB), and, for example, a front of a module parallel thereto may be easily and inexpensively manufactured. A further object of the invention is to provide a connector which is able to compensate for positional inaccuracies.

This object is achieved by the coaxial connector part, in particular the high-frequency coaxial connector, defined in the independent patent claims.

In one embodiment, a high-frequency coaxial connector is composed of a first coaxial connector part and a second connector part which is operatively connectable thereto. The first connector part is configured in such a way that it may be integrated into a front plate of a housing (module). For the first connector part, a contact pin (second connector part) is affixed at a corresponding position on a printed circuit board by soldering, for example. The contact pin may be affixed to a surface of the printed circuit board or inserted through a hole in the printed circuit board and then soldered, for example. In one embodiment, the first plug-in connector has an insulator, a pin-shaped inner conductor, and a connecting sleeve which is attached to the inner conductor. The connecting sleeve has a flange at the rear end which is held in a groove in the insulator in the mounted state.

The end of the inner conductor pin on the printed circuit board side is configured in such a way that it allows a certain lateral deflection of the contacting bushing in a defined area. The inner conductor advantageously has a ball-shaped end area on its end on the printed circuit board side, which in the mounted state protrudes into the bushing and contacts same in an electrically conductive manner along an inner surface. Depending on the requirements, end areas having another shape may be used. For example, for an end surface having a shape that is not ball-shaped, a restoring force may be generated by deforming the resilient connecting sleeve in a controlled manner during a deflection.

The insulator, inner conductor pin, and bushing may be affixed as a preassembled module in the front plate by pressing in, for example. The front plate may be used as an outer conductor of the connector. A conductive electromagnetic interference (EMI) seal is advantageously used as a high-frequency shield between the front plate and the printed circuit board. In one embodiment, this shield is embedded in the front plate in an overhanging manner. The EMI seal contacts the mass of the printed circuit board. In the operatively connected state, the shield is compressed in the axial direction as a function of the distance between the front plate and the printed circuit board.

Approaches known from the prior art are generally based on a plug-in connector pair having a first and a second connector part which are operatively connectable to one another via a coaxially configured transition piece. The connector parts as well as the transition piece have a coaxial design which is often complicated, and are therefore comparatively expensive. Other connectors known from the prior art contact the printed circuit board without a sufficient HF shield, or have inadequate tolerance compensation. A connector according to the invention does not have these disadvantages, and is limited to a minimum of components.

In one embodiment, the coaxial connector includes a first coaxial connector part having an outer conductor and an inner conductor which is held relative to the outer conductor by means of an insulator. The inner conductor is situated in an opening in the insulator, and has an end piece which is operatively connected in an electrically conductive manner to a connecting sleeve having an electrically conductive design. The connecting sleeve is mechanically operatively connected to the insulator via first operative connection means. The mechanical operative connection is configured in such a way that the connecting sleeve may be tilted in the lateral direction by an angle $\alpha$. A length compensation in the axial direction (perpendicular to the oppositely situated printed circuit board) is made possible, for example, by the operative connection to a second, pin-shaped connector part as described below.

The first connector part may have a ball-shaped end piece which in the mounted state cooperates with an inner surface of the connecting sleeve. The operative connection means may be composed of a thickened area provided on the connecting sleeve and a groove, situated inside the opening in the insulator, in which the thickened area engages in the mounted state. The thickened area and the groove are advantageously configured in such a way that the connecting sleeve may be tilted in the lateral direction by up to a certain tilt angle, i.e., deflection angle. Good results are achieved when the thickened area is situated above the end piece, since in this way the possible tilt angle is not negatively limited. If necessary, the connecting sleeve may have slits which make the edge areas elastic so that the connecting sleeve may be snapped in.

In one embodiment, the connecting sleeve has an inwardly directed protrusion having a conical guide surface which opens into a connecting opening that is suitable for accommodating a pin-shaped second connector part. The outer conductor may have a contact surface which may be used for contacting a printed conductor on a printed circuit board. Alternatively or additionally, the outer conductor may be operatively connected to an electrically conductive seal which is used for contacting a printed conductor on a printed circuit board. The connector according to the invention provides a good high-frequency shield, and at the same time allows positional inaccuracies to be compensated for in the axial and radial directions. In one embodiment of the coaxial connector which is suitable for bridging a distance of 9 mm between a printed circuit board (PCB) and a device front plate, an axial offset of up to 1 mm and a radial offset of up to 0.5 mm may be compensated for. Other areas are possible with an appropriate configuration. The connector according to the invention is particularly suited for an inexpensive "floating" connection of high-frequency components on a printed circuit board. It is generally necessary only to solder a simple inner conductor pin to the printed circuit board. The high-frequency shield may be optimally ensured, even when there are geometrical misalignments between the elements to be contacted. In one field of application, a filter is in direct operative connection with a printed circuit board of a duplexer in a mobile wireless base station.

BRIEF DESCRIPTION OF THE DRAWINGS

Exemplary embodiments of the invention are described with reference to the following figures, which show the following.

DETAILED DESCRIPTION OF THE INVENTION

Figure 1:
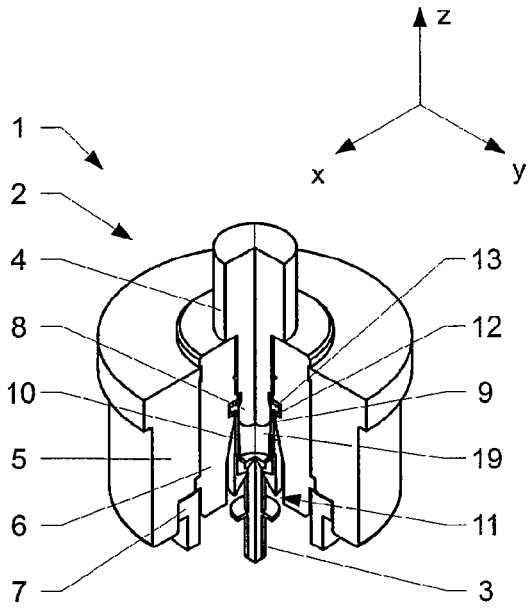
FIG. 1 shows a first embodiment of a coaxial connector according to the invention, in a perspective illustration obliquely from above.
Figure 2:
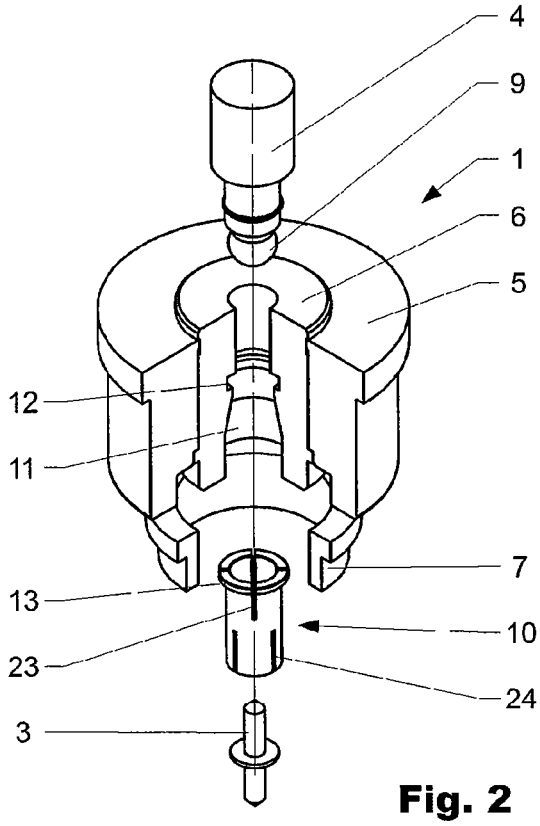
FIG. 2 shows the coaxial connector according to FIG. 1 in an exploded illustration.
Figure 3:
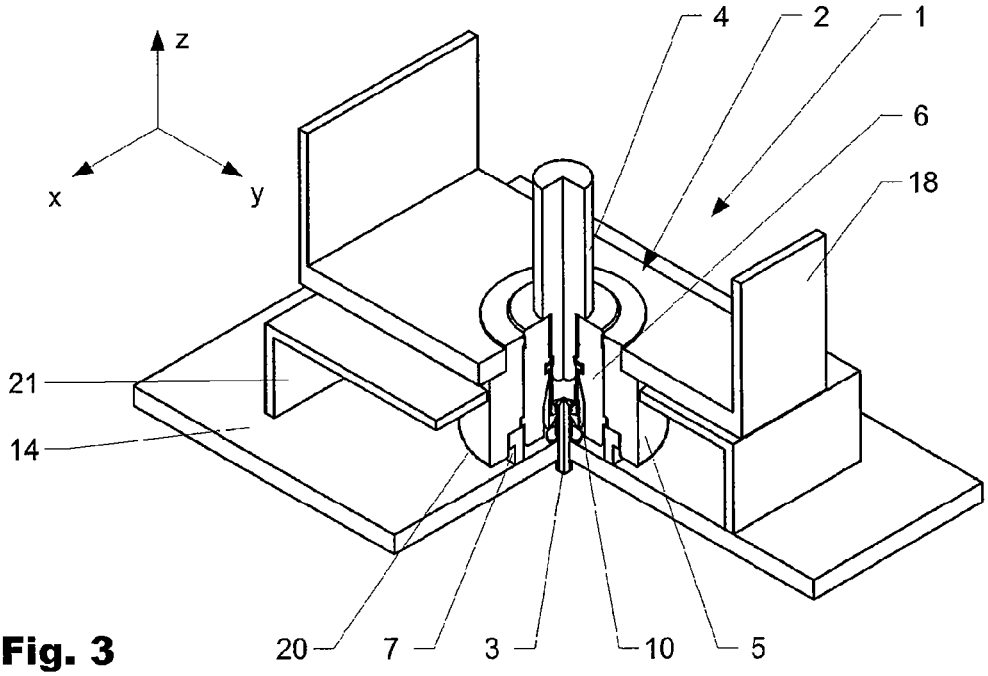
FIG. 3 shows the coaxial connector according to FIG. 1 in the mounted state.
Figure 4:
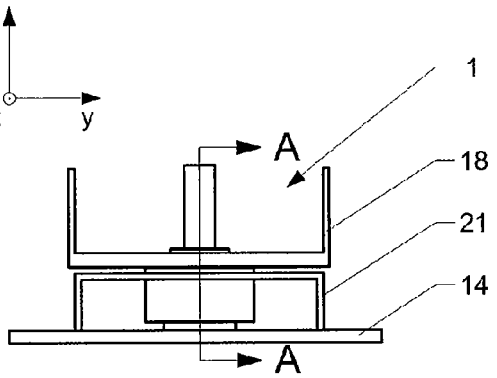
FIG. 4 shows the coaxial connector according to FIG. 1 in a side view.
Figure 5:
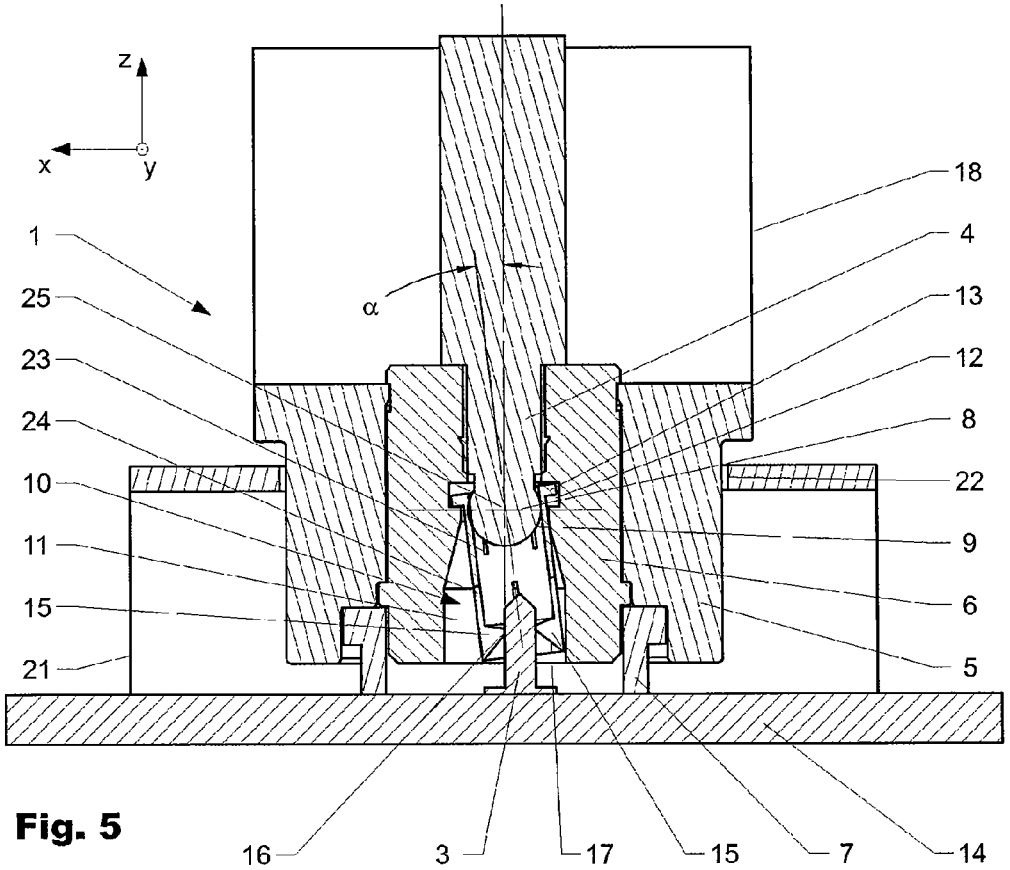
FIG. 5 shows a sectional illustration of the coaxial connector along the section line AA according to FIG. 4.
Figure 6:
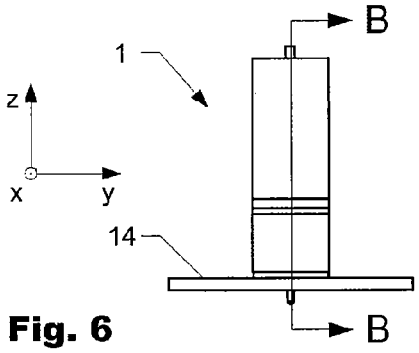
FIG. 6 shows a second embodiment of a coaxial connector according to the invention in a side view.
Figure 7:
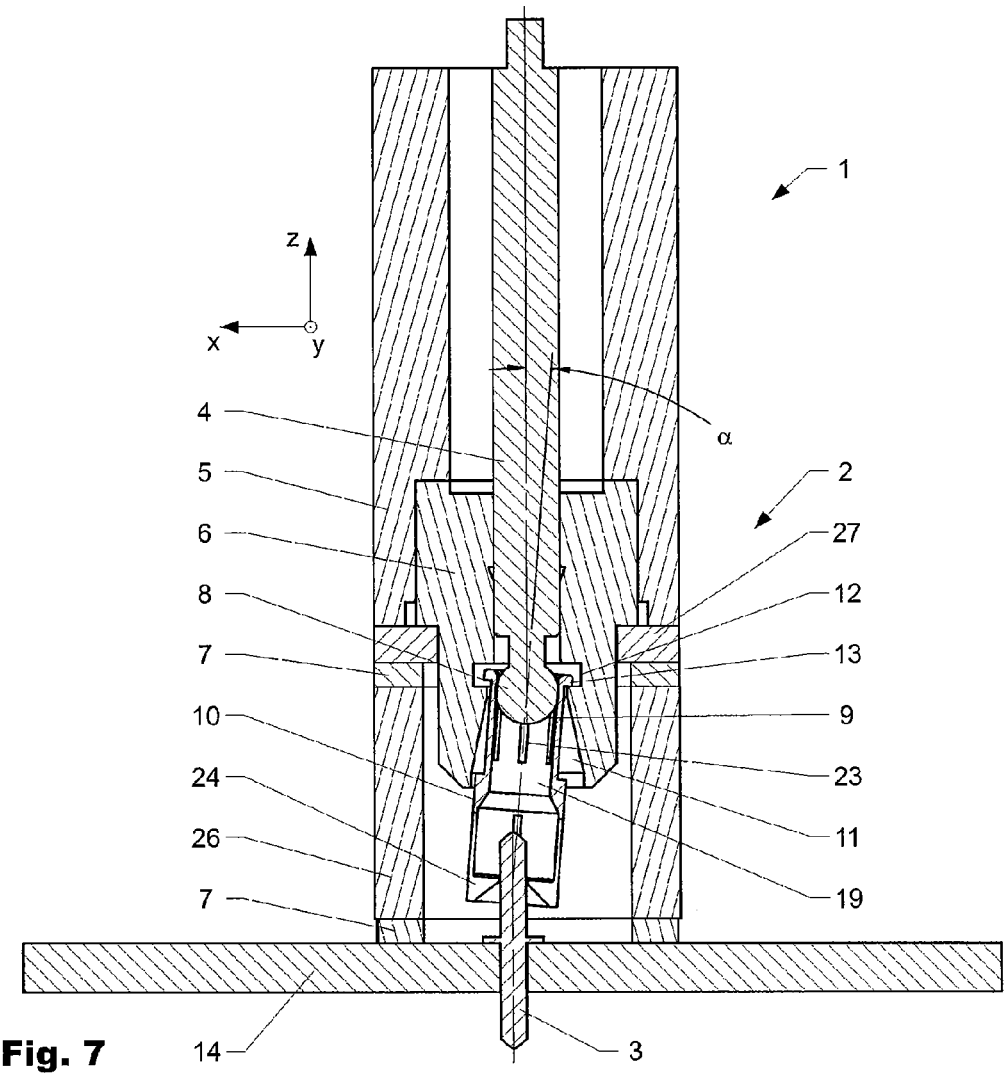
FIG. 7 shows a sectional illustration of the coaxial connector along the section line BB according to FIG. 6.

FIG. 1 shows a first embodiment of a coaxial connector 1 according to the invention in a perspective illustration obliquely from above. FIG. 2 shows the same coaxial connector 1 in an exploded illustration. FIG. 3 shows the coaxial connector 1 in the mounted state. FIG. 4 shows the coaxial connector 1 in a side view, and FIG. 5 shows the coaxial connector 1 in a sectional illustration along the section line AA. FIG. 6 shows a second embodiment of a coaxial connector 1 according to the invention in a side view, and FIG. 7 shows the coaxial connector 1 in a sectional illustration along the section line BB. Corresponding areas are provided with the same reference numerals in the individual embodiments.

FIGS. 1 and 2 illustrate the coaxial connector 1 in a cutaway view to provide better visibility of the interior of the coaxial connector 1.

The coaxial connector 1 is composed of a first connector part 2 and a second connector part 3. The first connector part 2 is affixed to a housing, for example, or is integrated into same. Depending on the field of application, the first connector part 2 may also be configured in such a way that it may be affixed to a printed circuit board.

The first connector part 2 has an inner conductor 4, an outer conductor 5, and an insulator 6. The insulator 6 is used for holding and positioning the inner conductor 4 relative to the outer conductor 5 (illustrated in a partial sectional view). The inner conductor 4 is pressed into the insulator 6 from above (z direction) until it reaches a stop. In the illustration shown, the insulator 6. is pressed into the outer conductor 5 from below. Other types of fastening and other structures are possible if necessary. In the embodiment shown according to FIGS. 1 through 5, the outer conductor 5 is part of a housing 18 of a larger device which is only schematically illustrated. The outer conductor 5 has a protruding design. The outer conductor protrudes through an opening 22 in a shield 21 which is situated on a printed circuit board 14. As shown in FIG. 3, the outer conductor 5 may also be designed as a separate part which is suitable for the operative connection to a housing and/or a printed circuit board by pressing in or soldering, for example.

In the present case, a seal (EMI seal) 7 is affixed to the lower end of the outer conductor 5 on the printed circuit board side. The seal 7 is made of electrically conductive material, and forms an electrically conductive operative connection between the outer conductor 5 and printed conductors (not illustrated in greater detail) of the printed circuit board 14. If necessary, the seal 7 may be made of a deformable material which forms a good conductive connection with a comparatively small contact force. Another advantage is that the seal allows shielding of the interior from external influences.

Depending on the field of application, the outer conductor 5 may also be brought into direct operative connection with the printed conductors of the printed circuit board 14.

The inner conductor 4 has an end piece 8, having an end surface 9 which in the present case is ball-shaped, and which in the mounted state engages with a connecting sleeve 10 and is in electrically conductive contact with same. Depending on the field of application, the end surface 9 may also have a configuration which is not a ball-shaped surface, provided that the lateral movement is not adversely affected.

The insulator 6 has an axial through opening 11 in which the connecting sleeve 10 is situated. The opening 11 has an undercut 12 (circumferential groove) in which a radially outwardly protruding thickened area 13 situated at the rear end of the connecting sleeve 10 is snapped in. The circumferential groove 12 and the thickened area 13 together form first operative connection means. In the embodiment shown, the undercut 12 is situated above a center 25 of the spherical end surface 9, thus achieving a fixed mechanical coupling and a good maximum deflection angle. The opening 11 widens in a funnel-like manner toward the lower end, so that the connecting sleeve 10, as illustrated in FIG. 5, is deflectable in the lateral direction by a deflection angle α. In the embodiment shown, the opening 11 is configured in such a way that it laterally supports the connecting sleeve 10 during maximum deflection. The flange 13 and the undercut 12 are designed in such a way that they counteract inadvertent tilting of the connecting sleeve 10.

In the operatively connected state (see FIGS. 1, 3, and 5), the connecting sleeve 10 cooperates with a contact pin 3 (second connector part) which is affixed to a printed circuit board 14 oppositely situated from the housing 18 by soldering, for example (variant according to FIG. 5) or insertion and soldering (variant according to FIGS. 1 through 3). In the embodiment shown, the connecting sleeve 10 has an inwardly directed protrusion 15 on the lower end which forms a contact opening 16, in front of which a funnel-shaped guide surface 17 is situated. In the operatively connected state, the contact pin 3 engages with the contact surface 16 and forms an electrically conductive connection with same. The guide surface 17, also with a certain lateral displacement, assists in bringing the connecting sleeve 10 into the correct position with respect to the contact pin 3. The connecting sleeve 10 is situated so as to be displaceable along the contact pin 3, so that an axial length compensation (z direction) is possible. The maximum possible axial length compensation is determined, among other factors, by the length of the contact pin and the configuration of the connecting sleeve 10.

To allow the thickened area 13 to be snapped into the circumferential groove 12 at the rear end of the connecting sleeve 10, the connecting sleeve 10 has first slits 23 which ensure that the rear end may be elastically deformed while being snapped in. The connecting sleeve 10 has second slits 24 at the front end which ensure that the front end of the connecting sleeve 10 may be elastically widened in the area of the contact opening 16 so that the contact pin 3 may be inserted into same.

The inner conductor 4, the outer conductor 5, and the connecting sleeve 10 are preferably manufactured as rotary parts (turning parts) made of metal.

In principle, the embodiment according to FIGS. 6 and 7 has the same design as the embodiment according to FIGS. 1 through 5. Reference is made to the corresponding statements in the general description. As is apparent in the sectional illustration according to FIG. 7, in the second embodiment two EMI seals 7 are present which operatively connect the outer conductor 5 to the printed circuit board via an outer conductor sleeve 26. In the embodiment shown, the two EMI seals 7 and the outer conductor sleeve 26 are adhesively bonded to the printed circuit board 14, and remain on same when the first connector part is detached. If necessary, other separations are possible. For example, the upper seal 7 and the outer conductor sleeve 24 may remain on the first connector part 2. In another embodiment, both seals 7 and the outer conductor sleeve 24 may remain on the first connector part 2 when the first connector part 2 is detached from the second connector part 3. The insulator 6 is fixed in the outer conductor 5 by a mounting 27, which in the present case is ring-shaped.

Another difference is that the insulator 6 has a shorter design. The connecting sleeve 10 is deflectable in the lateral direction by a deflection angle α. The connecting sleeve 10 is laterally supported by the side wall of the funnel-shaped opening 11 during maximum deflection. The connector 1 shown is configured in such a way that a lateral displacement (radial direction, in the xy plane) between the first and the second connector part 2, 3 of up to 0.6 mm, and in the axial direction (z direction), of 1 mm, may be easily compensated for.

The invention claimed is:

1. A coaxial connector part (2) comprising:

an outer conductor (5), and an inner conductor (4) which is held relative to the outer conductor by means of an insulator (6) and which is situated in an opening (11) in the insulator (6) and includes an end piece (8) operatively connected in an electrically conductive manner to a connecting sleeve (10), the connecting sleeve (10) mechanically operatively connected to the insulator (6) via first operative connection means (12, 13), so that the connecting sleeve (10) may be tilted by a tilt angle α relative to the inner conductor (4), wherein the outer conductor (5) is operatively connected to an electrically conductive seal (7) for contacting a printed conductor on a printed circuit board (14).

2. The coaxial connector part (2) according to claim 1, wherein the end piece (8) is ball-shaped, and in the mounted state cooperates with an inner surface (19) of the connecting sleeve (10).

3. The coaxial connector part (2) according to claim 1, wherein the first operative connection means (12, 13) are formed by a thickened area (13) provided on the connecting sleeve (10) and a groove (12) situated inside the opening (11) in the insulator, in which the thickened area (13) engages in the mounted state.

4. The coaxial connector part (2) according to claim 3, wherein the thickened area (13) is situated above a center of the end piece (8) in the axial direction (z).

5. The coaxial connector part (2) according to claim 1, wherein the opening (11) in the insulator (6) is configured in such a way that the connecting sleeve (10) is laterally supported by the inner wall of the opening (11) at a maximum tilt angle α.

6. The coaxial connector part (2) according to claim 1, wherein the connecting sleeve (10) includes an inwardly directed protrusion (15) which forms a contact opening (16), and a conical guide surface (17) that is suitable for accommodating a pin-shaped second connector part (3).

7. The coaxial connector part (2) according to claim 1, wherein the outer conductor (5) includes a contact surface for contacting a printed conductor on a printed circuit board.

8. The coaxial connector (1) having a first connector part (2) according to claim 1, and a second connector part (3) for the operative connection to the first connector part.

9. The coaxial connector according to claim 8, wherein the second connector part (3) includes a pin-shaped design.

10. The coaxial connector according to claim 9, wherein the second connector part (3) engages with the contact opening (16) and is displaceable relative to same in the axial direction (z).

* * * * *